United States Patent [19]

Mayer et al.

[11] 4,181,831

[45] Jan. 1, 1980

[54] TIRE DEFLATION MONITOR

[75] Inventors: William R. Mayer, Rochester; Lawrence E. Rieth, Springfield, both of Ill.

[73] Assignee: Stewart-Warner Corporation, Chicago, Ill.

[21] Appl. No.: 809,141

[22] Filed: Jun. 22, 1977

[51] Int. Cl.[2] ..... H01H 35/00

[52] U.S. Cl. ..... 200/61.25

[58] Field of Search ..... 200/61.22, 61.25, 83 B, 200/83 N, 83 P, 83 S, 159 B

[56] References Cited

U.S. PATENT DOCUMENTS

| | | | |
|---|---|---|---|
| 2,494,213 | 10/1950 | Sylvester et al. | 200/83 N |
| 3,555,220 | 1/1971 | Wood | 200/83 N |
| 3,860,772 | 1/1975 | Byrd | 200/61.25 X |
| 3,946,182 | 3/1976 | Holder | 200/159 B |
| 3,982,089 | 9/1976 | Hyltin | 200/159 B |
| 4,011,422 | 3/1977 | Sanford et al. | 200/159 B |
| 4,042,793 | 8/1977 | Bellenger | 179/90 K |

FOREIGN PATENT DOCUMENTS

| | | | |
|---|---|---|---|
| 2408621 | 9/1974 | Fed. Rep. of Germany | 200/83 N |
| 1204132 | 9/1970 | United Kingdom | 200/83 N |

*Primary Examiner*—James R. Scott

*Attorney, Agent, or Firm*—Augustus G. Douvas; Dillis V. Allen

[57] ABSTRACT

A tire deflation monitor and method of making the same including a pressure switch consisting of a cup-shaped conducting retainer element and a cup-shaped substantially rigid electrical conducting diaphragm that has a very short travel. The diaphragm closes against a conducting base member spaced very close to the diaphragm but separated therefrom only by a thin insulator so that the contact travel of the diaphragm is very short and the switch is very insensitive to temperature gradients. A first terminal is connected to the diaphragm and a second terminal is connected to the base member. The retainer is roll staked around the diaphragm and the conducting base member.

5 Claims, 6 Drawing Figures

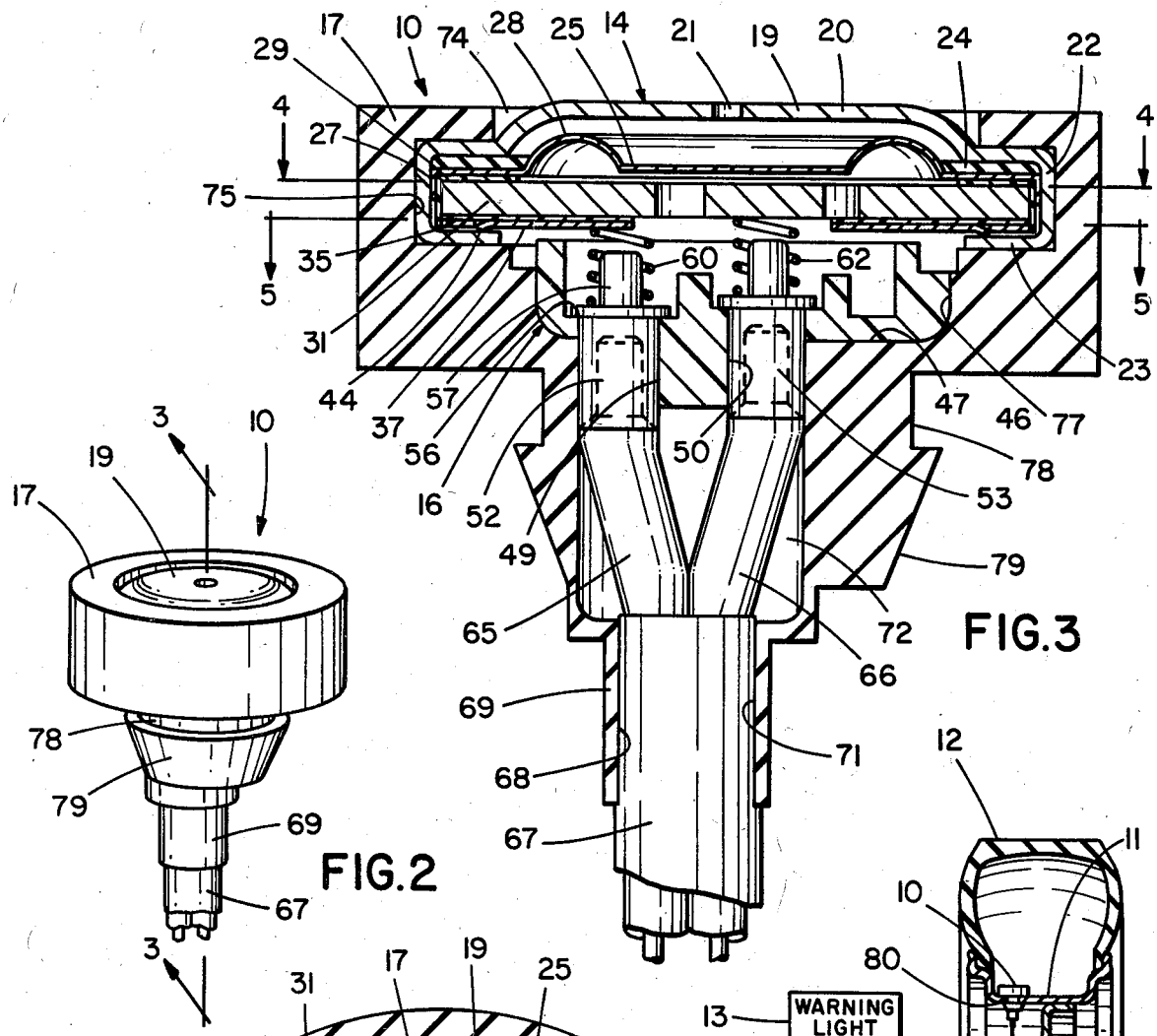
FIG.3
FIG.2
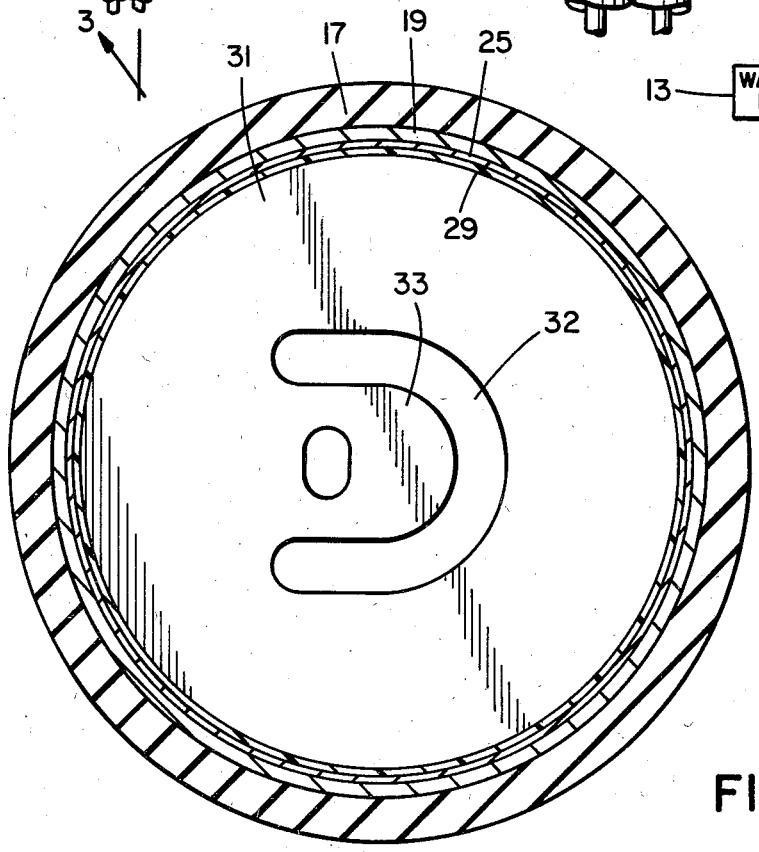
FIG.4
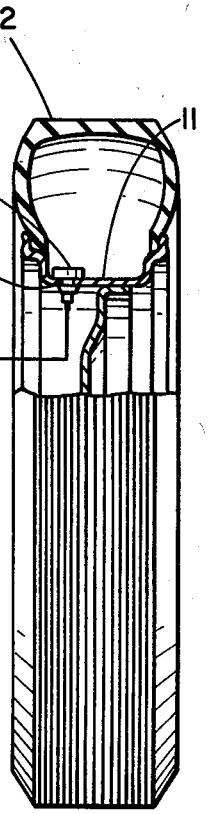
FIG.1

TIRE DEFLATION MONITOR

BACKGROUND OF THE PRESENT INVENTION

Pressure switches are of course in a highly developed art. Most pressure switches have high hysteresis losses due in part to biasing springs asociated with the diaphragm assemblies. Another disadvantage in many prior pressure switches is that the contact travel in the switch is significant and hence the switch becomes very sensitive to degradation of the contact set point pressure due to temperature gradients acting on parts in the switch that have high temperature coefficients. That is, an increase in temperature in many prior constructions causes an expansion of the plastic or metal which moves the contacts away from the diaphragm. An increase in pressure is thus required to make the switch work. A decrease in temperature works in the opposite manner. A further disadvantage in prior switch constructions is that due to the entrapment of air within the switch itself, temperature gradients causes pressure to build up within the switch and this also adversely affects the sensitivity of the switch itself.

All of these disadvantages in prior art pressure switches make them very undesirable for certain applications such as for tire deflation monitoring. The present pressure switch is particularly designed for this application where a very simple, rugged switch is required that has considerable accuracy but is also very insensitive to the temperature gradience that are conventionally experienced within the inside of a vehicular tire during operation. It is of course conventional to provide pressure switches for indicating tire pressure within vehicles, but all of the prior switches have one or more of the disadvantages described above, and it is to these problems that the present invention addresses itself.

SUMMARY OF THE PRESENT INVENTION

According to the present invention, a pressure switch is provided that is particularly adapted for use in monitoring the pressure within a vehicular tire to provide a warning to the operator of the vehicle with a warning light on the dashboard indicating when the tire pressure in one or more of the tires becomes excessively low. The present invention also provides a novel method for manufacturing the switch that basically includes the assembly of all the parts of the switch within a cup-shaped retainer and rollstaking the retainer around the parts placed within the retainer. This saves considerable manufacturing time and also provides proper electrical contact between the assembled elements to define the proper circuit path for the switch.

A rigid conducting metal diaphragm is placed within the cupshaped retainer and is in electrical contact with the retainer itself. The diaphragm has an annular recess that is semicircular in cross-section to provide the conducting diaphragm with the necessary rigidity. Also, the diaphragm is heat treated in nitrogen for two hours at 600° F. The diaphragm does not include any spring assemblies thereby reducing the hysteresis loss in the switch considerably. A conducting member is separated from the diaphragm by an 0.003 inch insulator, and it is this narrow insulator that determines the contact travel in the switch. Since the insulator is very thin, its dimensional characteristics do not vary to any significant extent with temperature gradient thus giving the switch its substantially constant temperature gradient characteristic. One terminal of the switch is connected to this conducting member by a spring. The other terminal is connected to the retainer through a spring and a conducting plate so that when sufficient pressure builds up between the retainer and the diaphragm, the diaphragm will move the 0.003 inch travel to the conducting base member completing an electric circuit path from the second terminal through the conducting plate, the retainer, the diaphragm, and the base member to the first terminal thereby closing the switch.

The retainer assembly after staking the retainer around the diaphragm, the insulator, the base member and the conducting plate is placed within a rubber grommet that has the terminals previously inserted therein. The entire switch is then placed in a suitable opening in the rim of the vehicle's wheels with the pressure port in the retainer exposed to pressure within the tire. The switch is normally intended to be closed in this application with pressure within the tire normally maintaining engagement between the diaphragm and the conducting base member and when pressure within the tire falls below the set point pressure of the switch, the diaphragm will move away from the conducting base member opening the switch and with suitable electrical connections energizing a warning light on the vehicle's control and display console.

A further feature of the present invention is that the conducting plate has a U-shaped slot in it defining a tab that may be bent upwardly during assembly toward the diaphragm to achieve the desired set point pressure of the switch in a very simple and inexpensive manner.

Other objects will become apparent from the detailed description of the invention.

BRIEF DESCRIPTION OF THE DRAWINGS

FIG. 1 is a front view of a wheel and tire assembly, partly in cross-section;

FIG. 2 is a perspective view of the switch assembly;

FIG. 3 is an enlarged cross-section of the switch assembly;

FIG. 4 is a cross-section taken generally along line 4—4 of FIG. 3;

DETAILED DESCRIPTION OF THE PREFERRED EMBODIMENT

Figure 6:
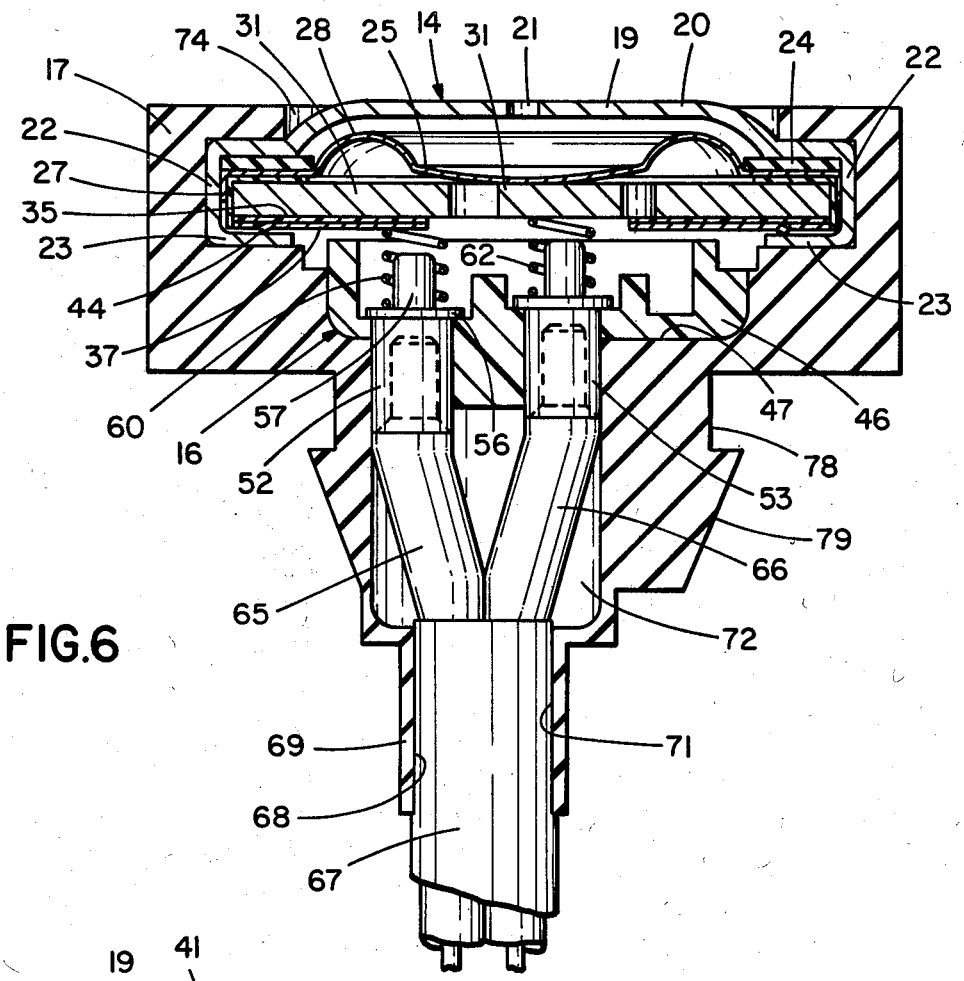
FIG. 6 is a cross-section similar to that shown in FIG. 3 with the diaphragm engaging the base plate when pressure is applied within the retainer.

FIG. 1 is a wheel and tire assembly showing a pressure switch 10 according to the present invention mounted within rim 11 and exposed to pressure within tire 12. The switch is designed so that when pressure within tire 12 falls below a certain predetermined set point pressure level, switch 10 will activate warning light 13 on the associated vehicle's control console. Of course, a suitable mechanism such as slip rings must be provided, to translate the signal from the rotating tire to the relatively stationary dashboard.

As seen in FIGS. 2 and 3, the present pressure switch 10 is seen to include a retainer assembly 14, a terminal assembly 16 and a rubber grommet 17 surrounding the retainer assembly.

Retainer 19 is cup-shaped in configuration prior to assembly. The retainer has a top wall 20 having a central aperture or port 21 therein which is exposed to the pressure to be sensed within the tire 12. The cup-shaped retainer 19 has a downwardly extending side wall 22 that is staked over the parts after assembly by roll-staking the side wall 22 providing an inwardly projecting clamping flange 23.

During assembly, an annular flat gasket 24 is placed within the cup-shaped retainer 19. A cup-shaped rigid metal diaphragm 25 is thereafter placed within the retainer in engagement with the lower surface of the gasket 24. The diaphragm 25 has a downwardly extending annular flange 27 that engages the depending side wall 22 of the retainer providing electrical contact with the retainer which provides part of the electrical circuit path for the switch itself. The diaphragm 25 has an annular recessed portion 28 having a generally semi-spherical cross-section to give the diaphragm the necessary rigidity required to provide a very short contact travel for the switch. The diaphragm is steel and is heat treated in a nitrogen atmosphere for two hours at 600° F.

After the placement of the cup-shaped diaphragm 25 within the retainer 19, a cup-shaped insulator 29 is placed within the cup-shaped diaphragm 25. This insulator is 0.003 inches in thickness and constructed of a suitable plastic. The insulator determines the contact travel of the switch and since it is very thin, the contact travel of the switch is also small rendering the switch substantially insensitive to temperature gradience since the only element whose temperature coefficients varies the sensitivity of the switch is the thin insulator 29.

A circular conducting metal base member 31 is then placed within the cup-shaped insulator 27. Base member 31 provides the other contact member for the switch with the diaphragm 25 of course being the other. The conducting base member 31 has a U-shaped slot 32 therein defining a tab 33 that may be bent upwardly during assembly toward the diaphragm 25 to provide the desired contact travel and hence determine the set point pressure of the switch in a very simple and inexpensive manner.

Figure 5:
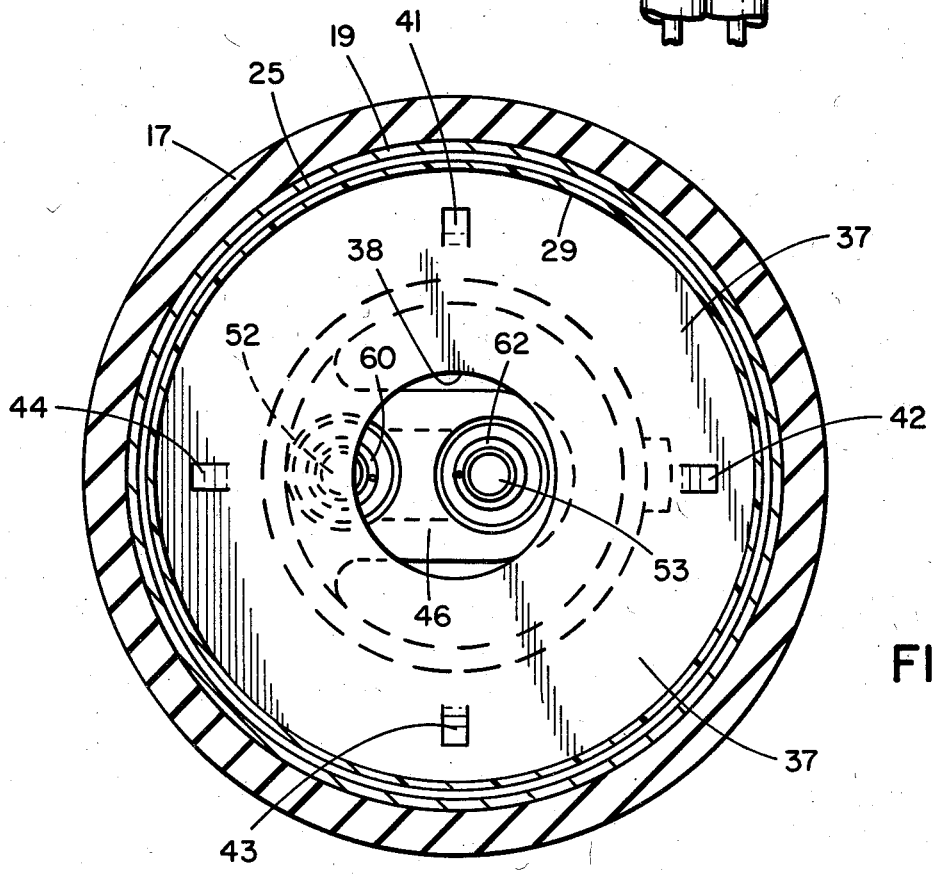
FIG. 5 is a cross-section taken generally along line 5—5 of FIG. 3.

An annular flat insulator 35 is next placed on the base member 31 and thereafter an annular conducting plate 37 is placed against the insulator 35. The conducting plate 37 has a central opening 38 as seen in FIG. 5 and has four downwardly projecting tabs 41, 42, 43 and 44 that engage the inwardly projecting flange 23 on the retainer providing good electrical contact with the retainer. Of course, insulator 35 electrically insulates the contact plate 37 from the base member 31.

After these elements have been placed within the cup-shaped retainer 19, the side wall 22 of the retainer is roll-staked around these elements bending inwardly extending flange 23 to its position shown in FIGS. 3 and 6 providing good electrical contact with the contact plate 37 by slightly bending tabs 41, 42, 43 and 44 upwardly during assembly as seen in FIG. 3, while at the same time holding all of the parts firmly in position to provide a very rugged and simple switch construction.

The terminal assembly 16 includes a rigid cup-shaped plastic retaining member 46 that is positioned within a complementary recess 48 within the rubber grommet 17. The terminal retainer 46 has apertures 49 and 50 that receive annular electrical terminal elements 52 and 53. Each of the terminal members 52 and 53 have a flanged portion 56 engageable with the upper surface of the retainer 46 and a reduced upward projection 57 that defines spring seats with the flanges 56.

A terminal spring 60 engages terminal 52 and extends between the terminal and the contact plate 37 to provide good electrical connection between the two and at the same time permitting very simple assembly of the retainer assembly 14 to the grommet 17 and the terminal assembly 16. Another contact spring 62 is provided between the contact member 53 and the base member 31.

The terminals 52 and 53 are connected respectively to wires 65 and 66 which extend through a protective plastic sleeve 67 tightly fitted within an aperture 68 within a downwardly extending projection 69 on the grommet 17. A small bleed passage 71 is provided, however, between the grommet projection 69 and the sleeve 67 so that chamber 72 within the grommet will be vented. This prevents any high temperature surrounding the switch from causing a buildup of pressure in chamber 72 which otherwise might adversely affect the sensitivity or accuracy of the switch.

The grommet 17 has a stepped opening 74 therein, an annular recessed portion 75 for receiving the retainer 19, and a counterbored portion 77 for receiving the terminal retainer 46.

Grommet 17 has an outer recess 78 adjacent a conical guide 79 so that the switch may be easily inserted through an aperture 80 shown in FIG. 1 in the rim of the vehicle wheel.

After the terminal assembly 16 is positioned within the grommet 17, the spring 60 and 62 are placed over the terminals and the retainer assembly 14 is inserted within grommet recess 75 in a very simple manner to produce the completed switch.

When sufficient pressure builds up within tire 12, pressure within the tire acting through retainer port 21 will move the diaphragm 25 downwardly into engagement with the base member 31 and it is shown in this position in FIG. 6. This provides electrical contact between terminals 52 and 53 through spring 60, contact plate 37, tabs 41, 42, 43 and 44, retainer portions 23, 22, diaphragm 25, base member 31, spring 62 to terminal 53. This closes the circuit. When pressure falls within the tire 12 to the predetermined set point pressure, the diaphragm 31 will move out of electrical contact with the base plate 31 opening the switch and providing a suitable signal for an instrument such as a warning light on the control and indicating console of the vehicle.

What is claimed is:

1. A pressure switch, comprising; a retainer having a pressure sensing chamber therein, a single fluid impervious circular substantially rigid electrical conducting metal diaphragm therein, said diaphragm being springless and secured to the retainer around the periphery of the diaphragm, an electrical substantially flat conducting base member spaced a small distance from the diaphragm and insulated therefrom, said conducting member having a curved slot therein, defining a tab that is adjustable toward and away from the diaphragm to determine the set point of the switch, first terminal means permanently connected to the diaphragm and second terminal means connected to the conducting base member whereby when sufficient pressure is applied to the retainer chamber the diaphragm will move the small distance into engagement with the conducting base member completing an electric circuit path between the first and second terminals.

2. A pressure switch as claimed in claim 1, wherein said retainer is annular and staked around the diaphragm and the conducting base member.

3. A pressure switch as claimed in claim 1, wherein the diaphragm has an annular recess having a substantially semi-circular annular cross section.

4. A pressure switch as claimed in claim 1, including a rubber grommet surrounding the retainer, an opening in the retainer exposed so that the pressure switch may be inserted into an opening in the wheel rim of a vehicle.

5. A pressure switch, comprising an annular retainer having a central pressure port therein, a gasket engaging the retainer, an electrical conducting diaphragm engaging the gasket and also engaging the retainer to provide electrical contact with the retainer, said retainer being constructed of a substantially rigid conducting metal, an annular recess in the diaphragm having a substantially semi-circular cross section, an insulator on the other side of the diaphragm from the gasket, a conducting base member engaging said insulator, said conducting base having a U-shaped slot defining a tab that is adjustable toward and away from the diaphragm to determine the set point of the switch, a second insulator on the other side of the base, a contact member on the second insulator and in electrical contact with the diaphragm through the retainer, first terminal means engaging said base member, and said terminal means engaging said contact plate whereby when pressure in said retainer chamber is sufficiently great the diaphragm will move into conducting engagement with the base member completing a current path from the second terminal through the contact plate, the retainer, the diaphragm, and the base member to the first terminal means.

* * * * *